US007620352B2

(12) United States Patent
Kawahara et al.

(10) Patent No.: US 7,620,352 B2
(45) Date of Patent: Nov. 17, 2009

(54) DEVELOPING DEVICE HAVING A PROJECTION PORTION FOR INHIBITING SCATTERING A DEVELOPER AND IMAGE FORMING APPARATUS USING SUCH DEVELOPING DEVICE

(75) Inventors: Ichiro Kawahara, Saitama (JP); Takafumi Wakai, Niigata (JP)

(73) Assignee: Fuji Xerox Co., Ltd., Tokyo (JP)

( * ) Notice: Subject to any disclaimer, the term of this patent is extended or adjusted under 35 U.S.C. 154(b) by 264 days.

(21) Appl. No.: 11/783,242

(22) Filed: Apr. 6, 2007

(65) Prior Publication Data

US 2008/0080906 A1 Apr. 3, 2008

(30) Foreign Application Priority Data

Sep. 29, 2006 (JP) ..... 2006-267987

(51) Int. Cl.
*G03G 15/09* (2006.01)

(52) U.S. Cl. ..... 399/277

(58) Field of Classification Search ..... 399/277, 399/265, 274, 267, 272
See application file for complete search history.

(56) References Cited

FOREIGN PATENT DOCUMENTS

JP 2004191433 A * 7/2004
JP A-2005-043501 2/2005

* cited by examiner

*Primary Examiner*—Quana M Grainger
(74) *Attorney, Agent, or Firm*—Oliff & Berridge, PLC

(57) ABSTRACT

A developing device comprises: a case having a developing opening; a cylindrical-shaped developer carry member disposed exposed in part to the developing opening, and rotatable for holding and carrying a developer; and a magnet member disposed fixed within the developer carry member and comprising two or more magnetic poles including a developing magnetic pole and a developer peel-off magnetic pole. In such portion of the case that not only is opposed to the outer peripheral surface of the developer carry member after it passes through the developing area but also corresponds to an area which extends from the developing magnetic pole in the rotation direction up to the developer peel-off magnetic pole and provides a normal direction magnetic flux density of 20 mT or less, a projecting portion where a clearance between its opposed portion and the outer peripheral surface of the developer carry member becomes narrowest is formed.

5 Claims, 12 Drawing Sheets

DEVELOPING DEVICE HAVING A PROJECTION PORTION FOR INHIBITING SCATTERING A DEVELOPER AND IMAGE FORMING APPARATUS USING SUCH DEVELOPING DEVICE

CROSS-REFERENCE TO RELATED APPLICATIONS

This application is based on and claims priority under 35 USC 119 from Japanese Patent Application No. 2006-267987 filed Sep. 29, 2006.

BACKGROUND (i) Technical Field

The present invention relates to a developing device and an image forming apparatus using such developing apparatus.

(ii) Related Art

Some of image forming apparatus represented by a printer, a copying machine and a similar machine using an electrophotographic system or an electrostatic recording system employ, as a developing device for developing a latent image to be formed on an image hold member such as a light sensitive member, a developing device which uses a developer (such as a two-component developer) containing toner and magnetic carriers.

In such developing device, generally, a developer stored in a portion of a housing (a case) is held by a magnetic force on a developing roller which is disposed with a portion thereof exposed to an opening facing a developing area opposed to the image hold member of the housing and also which can be rotated, and, after then, the thus-held developer is delivered to a developing area in such a manner that the layer thickness of the developer is regulated to a given thickness by a layer thickness restrict member. And, the developer (toner component) on the developing roller delivered to the developing area is electrostatically adhered to the latent image portion of the image hold member, thereby developing the electrostatic latent image. In this case, as the developing roller, there is mainly used a developing roller which is composed of a rotatable cylindrical-shaped sleeve and a magnet roller which is disposed such that it is positioned and fixed within the internal space of the sleeve and also in which there are provided two or more magnetic poles.

In the above-mentioned developing device, there is a possibility that the developer can fly around and float up to the outside from the area of the housing opening on the side where the outer peripheral surface of the developing roller passes after it passes through the developing area. Also, when the flying phenomenon of the developer occurs, there is a fear that the interior of the image forming apparatus can be contaminated by the developer, or, after such developer accumulates on the developing device and the like, the developer can be dropped down due to vibrations or the like to thereby result in a poor image.

SUMMARY

A developing device comprising: a case having a developing opening disposed opposed to a developing area; a cylindrical-shaped developer carry member disposed exposed in part to the developing opening of the case, and rotatable for holding and carrying a developer containing toner and magnetic carriers; and a magnet member disposed fixed within an internal space of the developer carry member and comprising two or more magnetic poles including a developing magnetic pole and a developer peel-off magnetic pole, the magnetic poles being arranged sequentially in a rotation direction of the developer carry member. In such portion of the case that not only is opposed to the outer peripheral surface of the developer carry member after it passes through the developing area but also corresponds to an area which extends from the developing magnetic pole of the magnet member in the rotation direction of the developer carry member up to the developer peel-off magnetic pole and provides a normal direction magnetic flux density of 20 mT or less, there is formed a projecting portion where a clearance formed between an opposed portion of the projecting portion and the outer peripheral surface of the developer carry member becomes narrowest.

DETAILED DESCRIPTION

Figure 1:
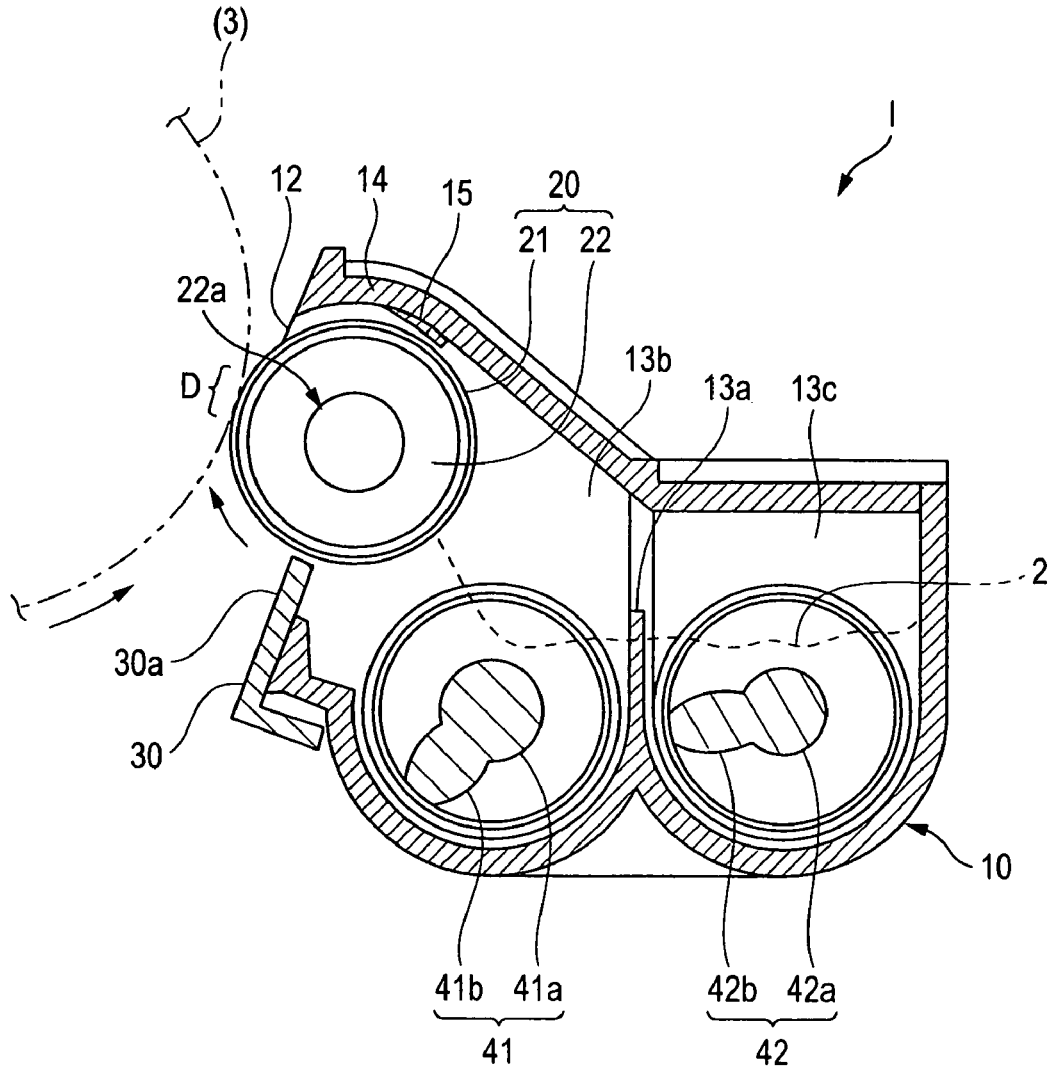
FIG. 1 is a schematic section view of the whole of a developing device according to an embodiment of the invention.
Figure 2:
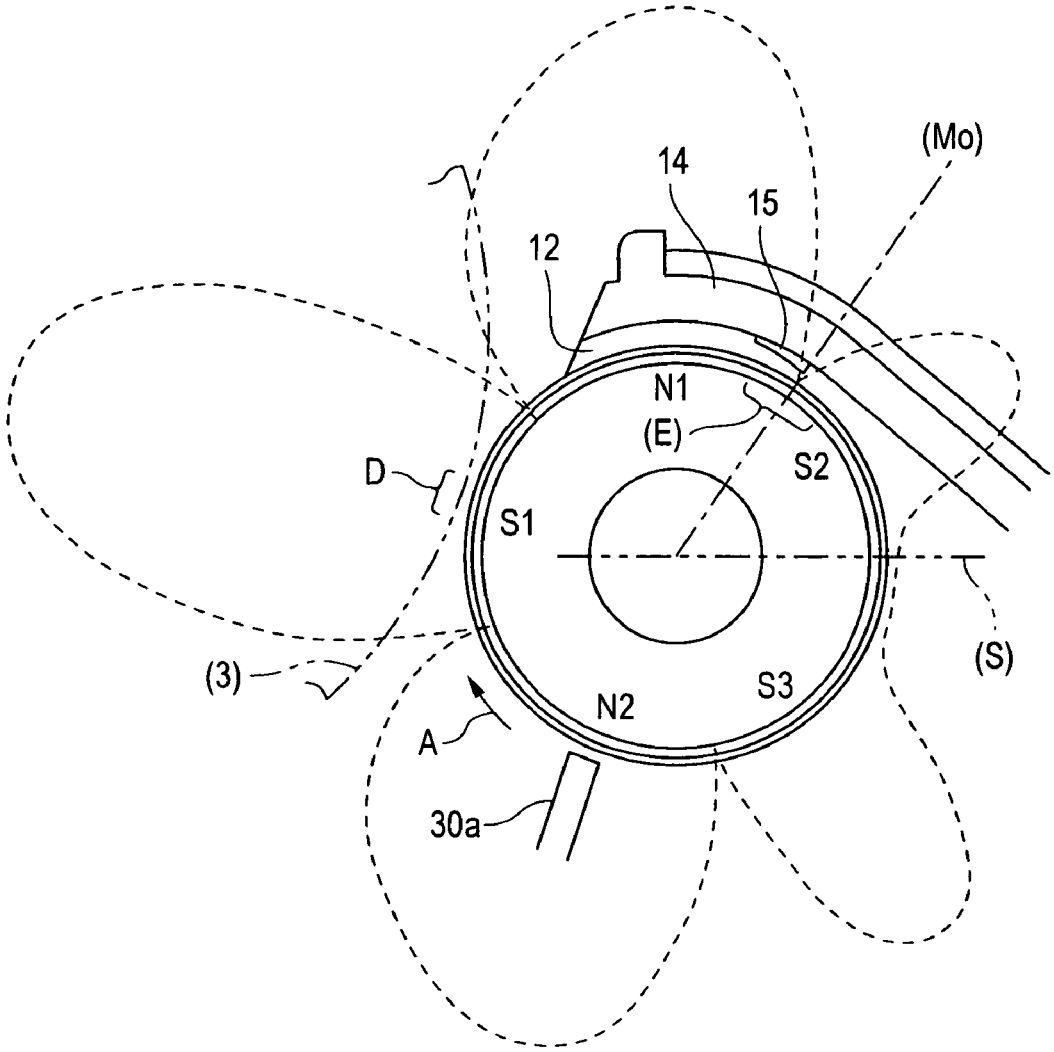
FIG. 2 is an enlarged explanatory view of the main portions of the developing device shown in FIG. 1.
Figure 3:
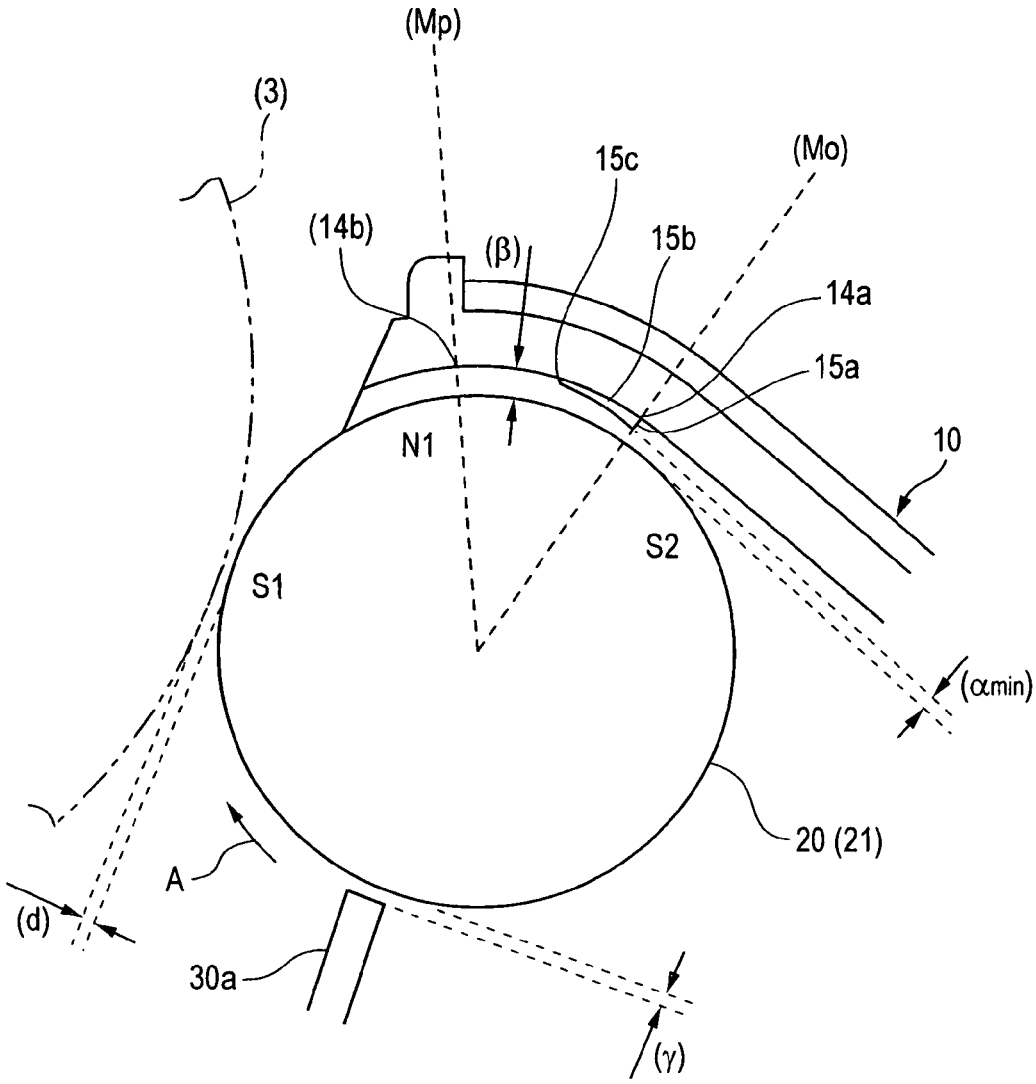
FIG. 3 is an enlarged explanatory schematic view of the main portions of the developing device shown in FIG. 1.

FIGS. 1 to 3 respectively show a developing device according to an embodiment of the invention. Specifically, FIG. 1 is a schematic section view of the present developing device, while FIGS. 2 and 3 are respectively explanatory enlarged views of the main portions of the present developing device.

Basically, this developing device 1 is mainly composed of a housing 10 functioning as a case, a developing roller 20 functioning as a developer carry member, a trimming plate 30 functioning as a layer regulate member, and two screw augers 41, 42 each functioning as a developer stir/carry member. In FIG. 1, reference numeral 2 designates a two-component developer which contains nonmagnetic toner and magnetic carriers, 3 a sensitive drum functioning as an image forming member on which an electrostatic latent image is formed according to image information, and D a developing area existing on the sensitive drum 3, while arrow marks respectively stand for the rotation directions of rotating parts.

The housing 10 is structured as follows: that is, in the portion of the housing 10 providing its end portion that is opposed to the developing area D of the sensitive drum 3, there is opened up an opening 12 to which the developing roller 20 is in part exposed; and, in the portion of the housing 10 extending over the end portion thereof that is opposite to the opening 12, there is formed a developer storage portion 13 for storing the two-component developer 2 therein. The developer storage portion 13 includes two parallel arranged developer circulate/carry passages 13*b* and 13*c* which communicate with each other at the two end portions thereof and are separated in the central portions thereof by a partition wall 13*a*.

The developing roller 20 includes a cylindrical-shaped sleeve 21 which can be rotated in such a manner that it is exposed in part to the vicinity of the opening 12 of the housing 10, and a magnet roller 22 having two or more magnetic poles disposed in the internal space of the sleeve 21 at a given angle, while the positions of the sleeve 21 and magnet roller 22 are respectively fixed. Also, the developing roller 20 (specifically, the sleeve 21 thereof) can be driven and rotated when power is applied thereto from a rotation drive device (not shown), and, to the developing roller 20, there is applied from a developing bias power supply (not shown) a given developing bias which is used to form a developing electric field between the sensitive drum 3 and developing roller 20. As the developing bias, for example, there is applied a direct current on which an alternating current component is superimposed. By the way, the developing device 1 is set in such a manner that a clearance (d: see FIG. 3) between the developing roller 20 (specifically, the sleeve 21 thereof) and the outer peripheral surface portion of the sensitive drum 3 to provide the developing area D can have a given value.

The sleeve 21 is formed in a cylindrical shape having almost the same width (length) as an image formation effective area of the sensitive drum 3 in the axial direction thereof, and the sleeve 21 is made of nonmagnetic material (for example, stainless steel, or aluminum). Also, the magnet roller 22 includes five magnetic poles S1, S2, S3, N1 and N2 which are disposed properly on its roller shaft 22*a* so as to cooperate together in forming such a normal direction magnetic flux density distribution as shown by a dotted line in FIG. 2. Specifically, the magnetic pole S1 is a developing magnetic pole, the magnetic pole N1 is a post-development carry magnetic pole which is situated on the downstream side in the rotation direction of the sleeve with respect to the developing magnetic pole S1, the magnetic poles S2 and S3 are developer peel-off magnetic poles having the same polarity which are spaced apart from each other and are disposed on the downstream side in the sleeve rotation direction with respect to the post-development carry magnetic pole N1, and N2 is a developer carry and layer regulate magnetic pole which is positioned on the upstream side in the sleeve rotation direction with respect to the developing magnetic pole S1.

The trimming plate 30 is formed in a plate shape having almost the same length as the developing effective area of the sleeve 21 in the axial direction and is made of nonmagnetic material (for example, stainless steel). As the trimming plate, there may also be used other member, for example, a member which is structured such that magnetic material is bonded to the nonmagnetic material thereof. And, the trimming plate 30 is fixed to the portion of the housing 10 on the opening 12 side by installing means such as a screw in such a manner that the leading end portion 30*a* thereof is opposed to the surface of the surface of the developing roller 20 (sleeve 21) while having a clearance (γ: see FIG. 3) for regulating the layer thickness of the two-component developer 2 to be held on the surface of the developing roller 20 to a given thickness.

The screw augers 41, 42 are rotation members which are structured such that the vane portions 41*b*, 42*b* thereof for stirring and carrying the two-component developer 2 are wound spirally on their associated rotation shaft portions 41*a*, 42*a* at a given pitch. The screw augers 41, 42 are respectively mounted within the two developer circulate/carry passages 13*b*, 13*c* formed in the developer storage portion 13 of the housing 10 in such a manner that they can be rotated in a given direction to circulate and carry the developer 3 existing in the two carry passages in a given direction.

Also, in the present developing device 1, as shown in FIGS. 1 to 3, in the portion 14 of the housing 10 that exists in the vicinity of the opening 12 and becomes opposed to the outer peripheral surface of the developing roller 20 (specifically, the sleeve 21 thereof) after it passes through the developing area D, there is provided a projecting portion 15 where a clearance α between the portion 14 and the outer peripheral surface of the sleeve 21 becomes the narrowest in such a manner that the projecting portion 15 is substantially parallel to the axial direction of the sleeve 21. This opposed portion 14, basically, is formed as a cylindrical surface in which only the portion thereof near to the opening 12 extends almost parallel to the outer peripheral surface of the sleeve 21 while having a clearance β between the portion 14 and the outer peripheral surface of the sleeve 21 and the portion thereof going beyond such portion gradually parts apart from the outer peripheral surface of the sleeve 21.

The projecting portion 15 is formed in the opposed portion 14 of the housing 10, more specifically, at least in the portion of the opposed portion 14 that extends from the developing magnetic pole S1 of the magnet roller 22 in the rotation direction A of the sleeve 21 to the developer peel-off magnetic pole S2 and corresponds to an area E having a normal direction magnetic flux density of 20 mT or less. In the present embodiment, since one area E having a normal direction magnetic flux density of 20 mT or less exists between the post-development carry magnetic pole N1 and developer peel-off magnetic pole S2, the formation position of the projecting portion 15 is set in this area E. Reference sign Mo, which is shown by a one-dot chain line in FIG. 2 and in other figures, designates a point the normal direction magnetic flux density of which is 0 (zero) mT in the area E. This normal direction magnetic flux density can be confirmed by measuring it using, for example, a Gaussian meter (such as GM-4002 manufactured by Electromagnetic Industry Co.). Besides this method, the normal direction magnetic flux density can also be confirmed by watching visually or using an optical microscope that the rising direction of the outer peripheral surface of the sleeve goes in the tangential direction of the outer peripheral surface of the sleeve.

Figure 4:
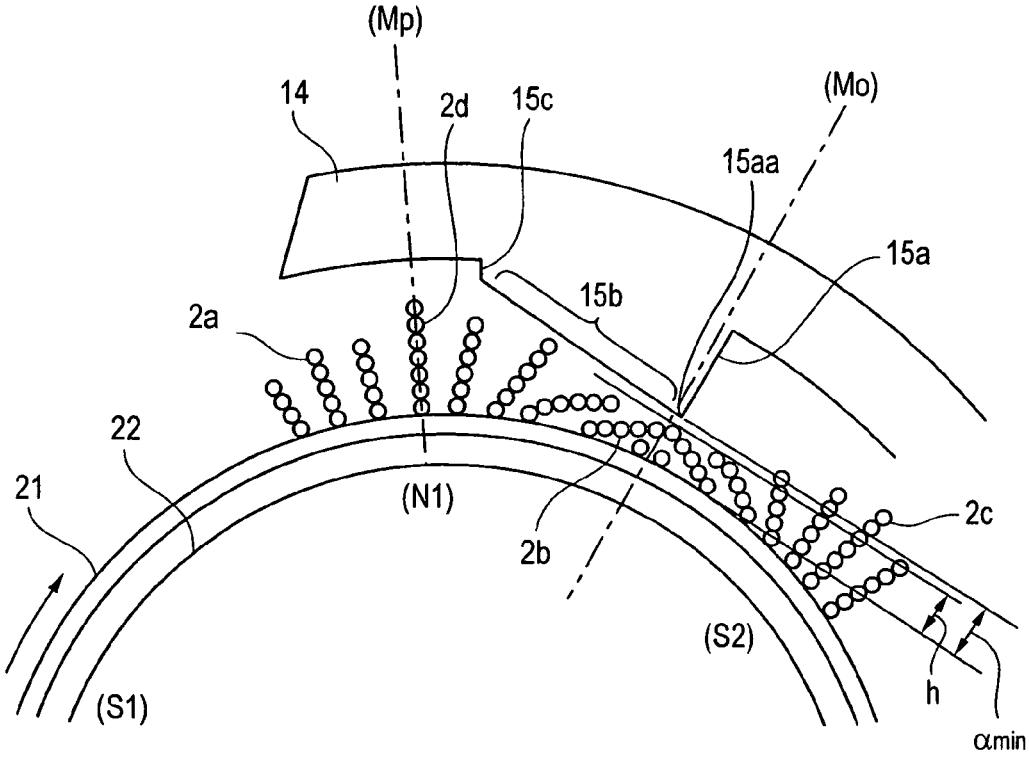
FIG. 4 is an enlarged explanatory view of a projecting portion and the magnetic brush of a developer passing before and after the projecting portion.

Also, the projecting portion 15 is formed such that, as shown in FIGS. 2 to 4, its end portion 15*a* existing on the downstream side of the rotation direction of the sleeve 21 not only almost coincides with the point 14*a* of the opposed portion 14 crossing the normal (Mo) of the sleeve 21 having a normal direction magnetic flux density of 0 mT but also provides a steep stepped surface (15*a*) extending almost parallel to the direction of the normal (surface). On the other hand, the portion 15*b* of the projecting portion 15, which exists on the upstream side of the rotation direction of the sleeve 21, increases as it approaches the portion 14*b* of the opposed portion 14 that corresponds to a point (a point which crosses a dotted line Mp) where the clearance a between the sleeve 21 and projecting portion 15 provides the peak value (in FIG. 2, the dotted line Mp) of the normal direction magnetic flux density of the post-development carry magnetic pole N1; in other words, the portion 15*b* is formed as an inclined surface the projecting height of which gradually decreases. Further, the end portion 15*c* of the projecting portion 15, which exists on the upstream side of the rotation direction of the sleeve 21, is formed to remain at a position existing on this side of the portion 14*b* so that it is prevented from existing on the portion 14*b* corresponding to the point that provides the peak value of the normal direction magnetic flux density of the above-mentioned post-development carry magnetic pole N1.

The projecting portion 15 according to the present embodiment is formed such that, in the projecting corner portion (15*aa*: see FIG. 4) of the end portion 15*a* existing on the downstream side of the rotation direction A of the sleeve 21, the clearance α between the projecting portion 15 and the outer peripheral surface of the sleeve 21 provides the minimum value (α min). This clearance minimum value (α min) is set substantially the same value as the height of the rising head portion (magnetic brush) of the two-component developer 2 formed in the outer peripheral surface portion of the sleeve 21 that corresponds to the area E having the normal direction magnetic flux density of 20 mT or less. In this case, the projecting corner portion (15*aa*) of the end portion 15*a* is formed in a linear shape extending substantially parallel to the axial direction of the sleeve 21. Also, as regards the end portion 15*c* of the projecting portion 15 existing on the upstream side of the rotation direction of the sleeve 21, the clearance α between the projecting portion 15 and the outer peripheral surface of the sleeve 21 is set for the maximum value (in this case, a value substantially equal to the average clearance β of the opposed portion 14 of the housing 10). Further, the projecting portion 15 is disposed such that the portion 15*a* of the projecting portion 15 providing the minimum clearance (α min) is situated substantially at the opposite position to the trimming plate 30 with the sleeve 21 between them (at the opposite position which provides about 180° (180±40°) from the opposed position of the trimming plate 30 with respect to the sleeve 21).

As described above, according to the present projecting portion 15, its end portion 15*a*, where the clearance α between the projecting portion 15 and the outer peripheral surface of the sleeve 21 is the minimum value, is formed such that it exists at least within the area E which provides the normal direction magnetic flux density of 20 mT or less. Also, the projecting portion 15 is formed integrally with the housing 10 (at least the opposed portion 14 of the housing 10). However, the projecting portion 15 may also be provided separately from the housing 10 and, after then, the projecting portion 15 may be mounted onto the opposed portion 14.

Next, description will be given below of the operation of the present developing device 1.

When the image forming apparatus of an electrophotographic system incorporating the developing device 1 therein is in a mode for forming an image, firstly, the developing roller 20 and augers 41, 42 start to rotate and, at the same time, a developing bias voltage is applied to the developing roller 20. Thus, the two-component developer 2 stored in the developer storage portion 13 of the housing 10 is circulated and carried within the circulation passage of the developer storage portion 13 while it is being stirred up by the rotating augers 41, 42. In this operation, the toner of the two-component developer 2 is fully stirred with carriers, whereby the toner is frictionally charged and is also stuck on the surface of the carriers electrostatically.

Then, part of the two-component developer 2, which is carried by the auger 41 situated near to the developing roller 20, is held by the magnetic force of the developing roller 20. That is, on the surface of the rotating sleeve 21 of the developing roller 20, there are held a large number of chain-like connected magnetic carriers with the toner stuck thereon by the magnetic forces of the magnetic poles S3, N2 of the magnet roller 22 in a state where the magnetic carriers with the toner stuck thereon form a magnetic brush. Next, when the two-component developer 2 held by the sleeve 21 passes through a given clearance (γ) formed between the sleeve 21 and trimming plate 30 while the developer 2 is being carried with the rotation of the sleeve 21, the passing state of the two-component developer 2 is regulated, whereby the layer thickness (the magnetic brush height) of the two-component developer 2 is turned into a substantially even thickness.

After then, the two-component developer 2, the layer thickness of which is regulated in this manner, is carried to the developing area D disposed opposed to the sensitive drum 3 with the rotation of the sleeve 21 of the developing roller 20. Next, the two-component developer 2 carried to the developing area D is made to pass in a state where the leading end portion of the magnetic brush formed by the magnetic force of the developing magnetic pole S1 is contacted with the outer peripheral surface of the sensitive drum 3; and, in such passage of the two-component developer 2, owing to a developing (alternating) electric field formed between the developing roller 20 and sensitive drum 3 by a developing bias voltage applied to the developing roller 20, only the toner of the two-component developer 2 is electrostatically stuck onto an electrostatic latent image on the sensitive drum 3. Thus, the development of the electrostatic image is carried out by the developing device 1.

Also, the two-component developer 2 on the developing roller 20 after it has passed through the developing area D is then carried while it is held on the sleeve 21 by the magnetic force of the post-development carry magnetic pole N1 and, after then, when it passes through between the developer peel-off magnetic poles S2 and S3, in principle, it is peeled off from the sleeve 21 due to a repelling magnetic force (magnetic field) formed by the developer peel-off magnetic poles S2 and S3 having the same polarity, and is then returned into the housing 10. The thus peeled and returned developer 2 is stirred again within the developer storage portion 13 of the housing 10. On the other hand, onto the developing roller 20 from which such developer has been peeled off, there is supplemented again the two-component developer 2 stirred within the developer storage portion 13 according to the above-mentioned principle, whereby the two-component developer 2 is supplied to and held by the developing roller 20.

And, in the present developing device 1, the two-component developer 2 held by the sleeve 21 of the developing roller 20 after having passed through the developing area D, when it passes with the rotation of the sleeve 21 in such a manner that it is opposed to the opposed portion 14 of the housing 10, is held in the following state.

Firstly, the two-component developer 2 on the sleeve 21, as shown in FIG. 4, when it passes a position opposed to the post-development carry magnetic pole N1 of the magnet roller 22, is moved on the sleeve 21 due to the magnetic force of the carry magnetic pole N1 while forming an angularly rising magnetic brush 2*a*.

Next, the developer 2 forming the magnetic brush 2*a*, when it passes the area E where the normal direction magnetic flux density between the post-development carry magnetic pole N1 and developer peel-off magnetic pole S2 is 20 mT or less, forms a magnetic brush 2*b* the rising head height of which decreases gradually as the magnetic flux density decreases; and, especially, when the developer 2 passes through the point (Mo) having a magnetic flux density of 0 mT, the developer 2 moves in a state where the magnetic brush 2*b* provides the lowest height (h).

In this case, since the two-component developer 2 on the sleeve 21 passes through the area E the magnetic force of which is weaker than its front and rear areas, the height of the magnetic brush is lowered; and, at the time when the magnetic brush 2*a* provides the lowest height (h), the developer 2 passes through (the corner portion 15*aa* of) the end portion 15*a* of the projecting portion 15 of the opposed portion 14 of the housing 10 where the clearance (α) between the projecting portion 15 and the sleeve 21 is set for the narrowest value (α min).

The two-component developer 2 on the sleeve 21 after having passed through the projecting portion 15 receives the magnetic force of the developer peel-off magnetic pole S2 as it approaches the developer peel-off magnetic pole S2, and moves while forming again an angularly rising magnetic brush 2*c*.

Thus, the two-component developer 2 held on the sleeve 21 after having passed through the developing area D, when it passes through the point (Mo) which belongs to the area E having a normal direction magnetic flux density of 20 mT or less and has a magnetic flux density of 0 mT, passes through (the corner portion 15*aa*) of the end portion 15*a* of the projecting portion 15 where the minimum clearance α between the sleeve 21 and projecting portion 15 is set substantially equal to the magnetic brush height h. Especially, the height h of the magnetic brush 2*b* when the developer 2 passes through the area E having a normal direction magnetic flux density of 20 mT or less hardly depends on variations (increase and decrease) in the developer carry amount by the sleeve 21 and can be thereby easily held constant.

Therefore, between the end portion 15*a* of the projecting portion 15 of the opposed portion 14 of the housing 10 and the magnetic brush 2*b* on the sleeve 21 passing through such end portion 15*a*, an unnecessary gap is prevented against occurrence. That is, a space between the end portion 15*a* of the projecting portion 15 and the outer peripheral surface of the sleeve 21 is maintained in a stably closed state by the magnetic brush 2*b*. As a result of this, the developer (especially, toner) 2 existing within the housing 10 can be prevented from being discharged and flown out to the outside from the opening 12 of the housing 10 through an air gap which could be otherwise formed between the end portion 15*a* of the projecting portion 15 and magnetic brush 2*b*.

Also, the projecting portion 15, as shown in FIG. 4, is formed such that the end portion 15*c* thereof existing on the upstream side of the sleeve rotation direction does not exist in the portion 14*b* that corresponds to a point (Mp) where the normal direction magnetic flux density of the post-development carry magnetic pole N1 provides the peak value. Thanks to this, of the magnetic brush 2*a* formed in the sleeve 21 due to the magnetic force of the normal direction magnetic flux of the carry magnetic pole N1 providing the peak value, the greatest height h portion 2*d* can be prevented from colliding with the whole of the projecting portion 15 and, especially, the end portion 15*a* thereof providing the narrowest clearance (α). This can prevent the occurrence of a phenomenon that the magnetic brush portion 2*d* can collide with the projecting portion 15 and the toner sticking to the carriers of the magnetic brush 2*d* can be thereby separated therefrom and flown (floated) toward the opening 12 of the housing 10.

Further, the projecting portion 15, as shown in FIG. 4, is formed such that the portion 15*b* thereof existing on the upstream side of the sleeve rotation direction is formed as an inclined surface which decreases gradually in the projecting height as it goes toward the rotation direction upstream side. Thanks to this, the magnetic brush 2*a* (especially, a brush portion formed on the downstream side of the sleeve rotation direction from a point where the normal direction magnetic flux of the post-development carry magnetic pole N1 provides the peak value) formed by the magnetic force of the post-development carry magnetic pole N1 can be prevented from colliding with the portion 15*b* of the projecting portion 15 formed as an inclined surface. This can prevent the occurrence of the flying (floating) of the developer that could be otherwise caused by the positive (more than necessary) collision of the magnetic brush portion 2*a* with such portion 15*b* of the projecting portion 15 of the housing 10 that is formed as an inclined surface.

Figure 5:
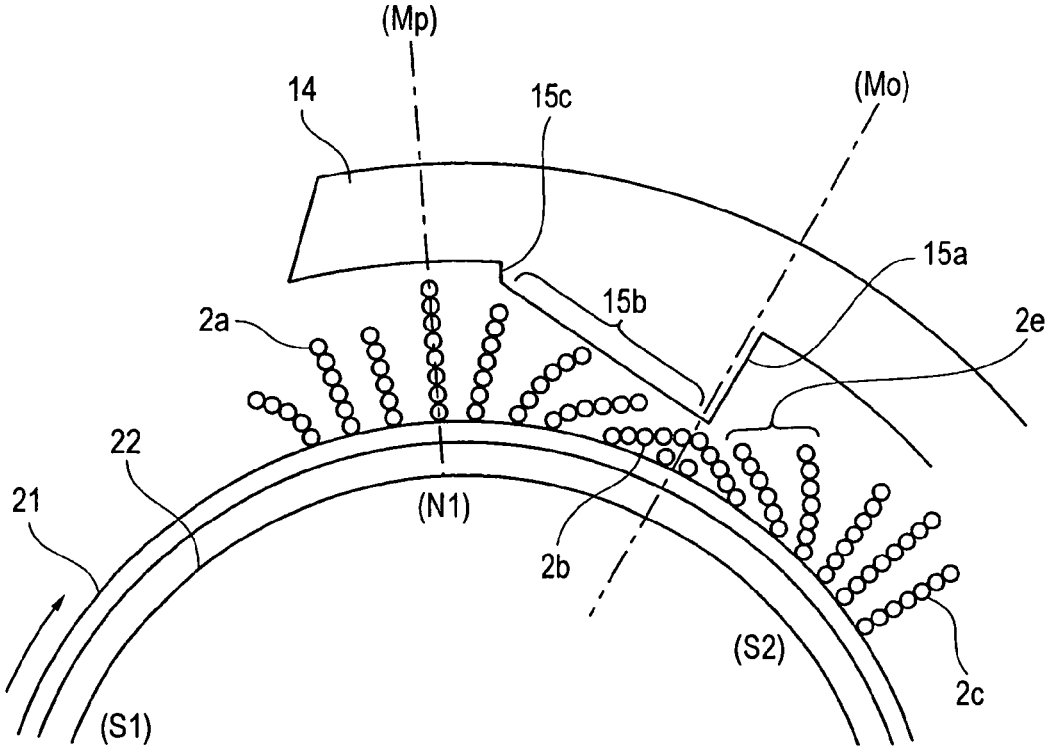
FIG. 5 is an enlarged explanatory view of a projecting portion and the magnetic brush of a developer passing before and after the projecting portion when a developer carry amount is large.
Figure 6:
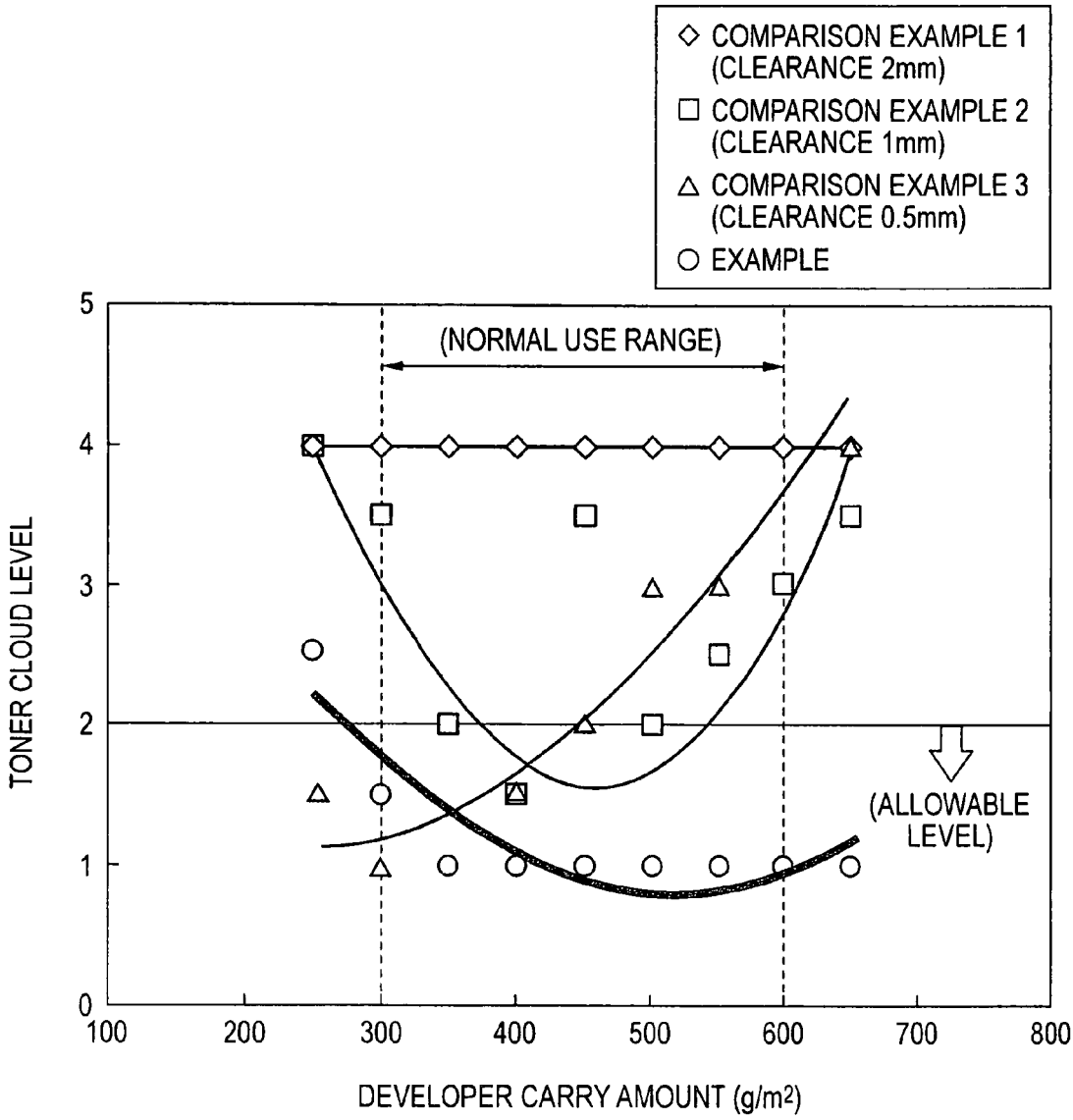
FIG. 6 is a graphical representation of the results of a test 1.

In addition, since the projecting portion 15, as shown in FIG. 5, is formed such that the end portion 15*a* existing on the upstream side of the sleeve rotation direction is formed as a stepped surface, for example, when a large amount of developer is carried on the sleeve 21, there can be provided the following effects.

That is, when the developer carry amount increases, the height of the magnetic brush on the sleeve 21 increases generally, which can give rise to a phenomenon (a so called inverted fall phenomenon) that the upper end portion of the magnetic brush 2*e* portion of the magnetic brush 2*c* formed by the magnetic force of the developer peel-off magnetic pole S2 just after the developer has passed through the projecting portion 15 can be curved and fallen on the upstream side of the rotation direction of the sleeve 21. However, even when such inverted fall phenomenon occurs, the inversely fallen portion of the magnetic brush 2*e* is contacted with the stepped surface of the end portion 15*e* of the projecting portion 15, while the stepped surface extends substantially parallel to a virtual line going outward in the diameter direction of the magnet member. As result of this, the steep stepped surface of the end portion 15*a* of the projecting portion 15 is closed by the magnetic brush portion which has fallen onto and contacted with such stepped surface, thereby preventing an unnecessary clearance from occurring between the projecting portion 15 and magnetic brush (2*b*). This prevents the occurrence of an air stream which flows toward the outside from the interior of the housing 10 through such clearance, thereby being able to prevent the developer from gushing and flying out on such air stream to the outside.

Also, since the projecting portion 15 is formed such that its portion 15*a* having the minimum clearance (α min) is situated at the opposite position substantially opposed to the trimming plate 30 with the sleeve 21 between them, there can be obtained the following operation effects. That is, firstly, when the sleeve 21 passes through the position opposed to the trimming plate 30, owing to the dense existence of the developer 2 in the clearance between the sleeve 21 and the leading end portion 30*a* of the trimming plate 30, the sleeve 21 is allowed to rotate stably in a state where it is slightly pushed up in the opposite direction to the trimming plate 30. Thanks to this, in the developing time, the sleeve 21 can rotate stably in a state where the variations of the position thereof are controlled properly, whereby the dimensional variations of the minimum clearance (α min) of the sleeve 21 with respect to the end portion 15*a* of the projecting portion 15 can be restricted properly. As a result of this, the occurrence of the unnecessary gap between the end portion 15*a* of the projecting portion 15 and magnetic brush 2*b* can be prevented further positively, thereby being able to prevent the flying of the developer further firmly.

Now, description will be given below of tests that have been conducted using the present developing device.

<Test 1>

In the test 1, using the developing device 1 (example of the invention) including the projecting portion 15 according to the above-mentioned embodiment and other developing devices (comparison examples 1 to 3) respectively excluding the projecting portion 15, the occurring states of the flying (toner cloud) of the developer when an image is formed using the respective developing devices are checked.

As the developing device 1 according to the example of the invention, there is prepared a developing device which satisfies the following conditions. That is, as the sleeve 21, there is used a sleeve which has a thickness of the order of 0.5 mm and an outside diameter of the order of 18 mm. As the magnet roller 22, there is disposed a developing magnetic pole S1 having an S polarity in such a manner that the peak value (120 mT or more) of the normal direction magnetic flux density can appear at a position which provides an elevation angle of about 15° from the horizontal line (in FIG. 2, a two-dot chain line S); there is disposed a post-development carry magnetic pole N1 having an N polarity in such a manner that the peak value (80~100 mT) of the normal direction magnetic flux density can appear at a position providing substantially a vertical angle of about 90° with respect to the horizontal line; and, there is disposed a developer peel-off magnetic pole S2 having an S polarity in such a manner that the peak value (40~70 mT) of the normal direction magnetic flux density can appear at a position providing an elevation angle of about 35° from the horizontal line. In this magnet roller 22, the point (Mo), where the normal direction magnetic flux density is 0 mT, is the position of the sleeve 21 that provides an elevation angle of about 60° from the horizontal line. The clearance γ between the trimming plate 30 and sleeve 21 is set for a value in the range of 0.4~0.6 mm.

Also, the minimum clearance (α min) between the sleeve 21 and end portion 15*a* existing on the downstream side of the sleeve rotation direction in the projecting portion 15 of the housing 10 is set for about 1.3 mm. The end portion 15*b* existing on the upstream side of the sleeve rotation direction in the projecting portion 15 is set at the same position as the point where the normal direction magnetic flux density of the carry magnetic pole N1 becomes about one half. And, the clearance β between the sleeve 21 and the opposed position 14 of the housing 10 is set for a value equal to or larger than about 1.5 mm.

Figure 11:
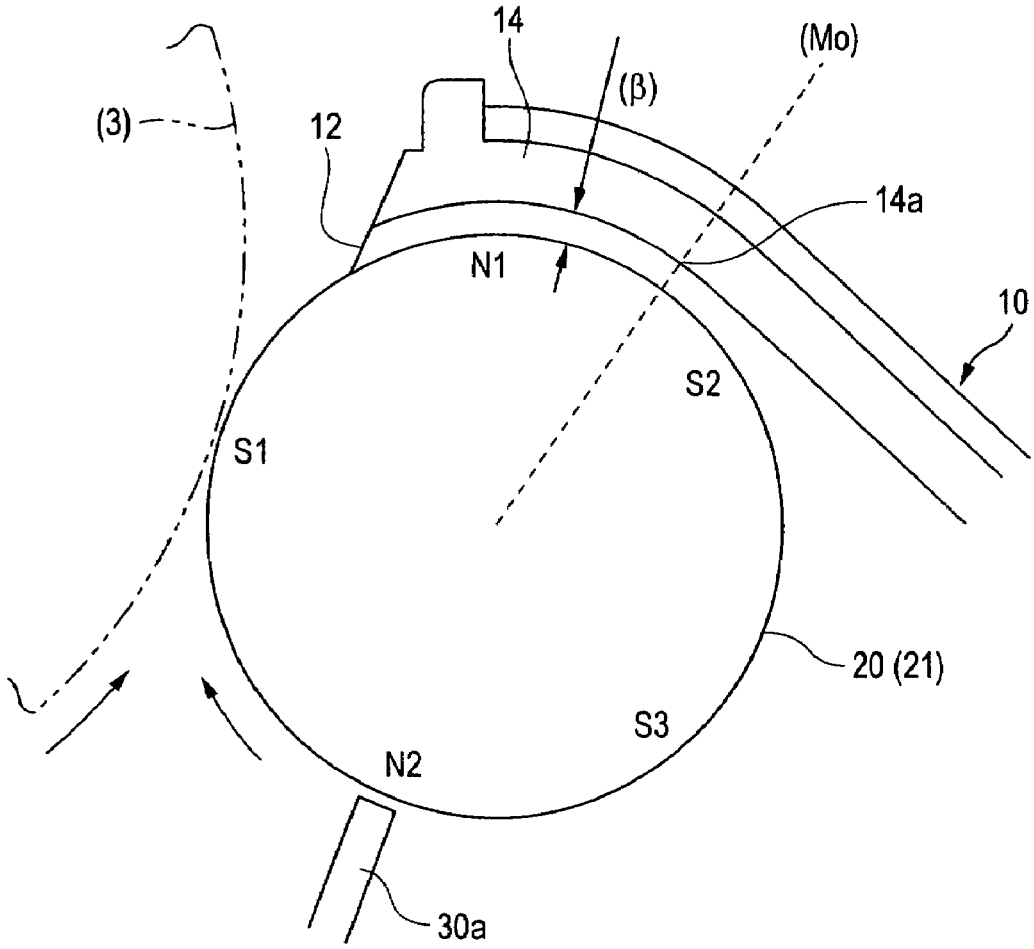
FIG. 11 is an explanatory view of the structure contents of comparison examples 1~3 used in the test 1.

On the other hand, as the comparison examples 1~3, there are prepared developing devices respectively satisfying the same conditions as the developing device according to the example of the invention except that the following conditions are changed. That is, as shown in FIG. 11, the projecting portion 15 is not formed in the opposed portion 14 of the housing 10 but the opposed portion 14 is formed substantially as a cylindrical surface in which the clearance β between the sleeve 21 and the opposed portion 14 in the range extending from the opening 12 to the portion 14*a* crossing the point (Mo) where the normal direction magnetic flux density is 0 mT is set for a given value. Specifically, the clearances β in that range are set for 2.0 mm (comparison 1), 1.0 mm (comparison 2) and 0.5 mm (comparison 3), respectively.

And, after the developing device according to the example and the developing devices according to the comparison examples are mounted on printers each of an electrophotographic system respectively, print for the test is carried out individually. In this case, the developing devices are respectively set such that a clearance d between the sleeve 21 and sensitive drum 3 provides about 0.35~0.50 mm, and the sleeve 21 is rotated at a sufficient velocity to allow the print speed to print 8 sheets/min. for recording paper of a horizontal A4 size (the print velocity is set about double the velocity of the sensitive drum 3 that is about 170 cm/sec.). As the developer 2, there is used a two-component developer containing non-magnetic toner having an average particle diameter of the order of 6 μm and magnetic carriers each having an average particle diameter of the order of 30 μm, with the toner having a density of about 11 wt %. The print for the test is carried out under the condition that test images each having an image density of 16% are successively formed on 1500 sheets of A4-size recording paper under the low-temperature and low-humidity environment of 10° C., 15% RH (the environment where a toner cloud is easy to occur). Also, the print is carried out by setting the developer carry amount of the sleeve 21 for values varied every 50 g/m$^2$ in the range of 250~650 g/m$^2$. For reference, the developer carry amount, in normal use, is set for values in the range of, for example, 300~600 g/m$^2$.

As for the occurring state of the toner cloud, after the above-mentioned print for the test is completed, toner, which had stuck to the portion of the housing 10 existing upwardly of the opening 12, is transferred to adhesive tape, the weight of the toner is measured, and the measured weight value is evaluated according to the following reference levels (toner cloud levels). Table 6 shows the evaluation results. In the table 6, together with the evaluation results, there are shown their respective approximate curves. Here, an allowable level may preferably be the level 2 or lower and, more preferably, the allowable level may be the level 1.

Level 1: Toner sticking amount is 0.015 g/m$^2$ or less

Level 2: Toner sticking amount is 0.030 g/m$^2$ or less

Level 3: Toner sticking amount is 0.050 g/m$^2$ or less

Level 4: Toner sticking amount is 0.075 g/m$^2$ or less

Level 5: Toner sticking amount is more than 0.100/m$^2$

<Test 2>

In the test 2, for the embodiment of the invention, there is used a developing device in which the forming position of the projecting portion 15 to be formed in the opposed portion 14 of the housing 10 is changed in the following manner. This developing device is applied to the printer and the occurring state of the flying (toner cloud) of the developer is checked when an image is formed.

Figure 12:
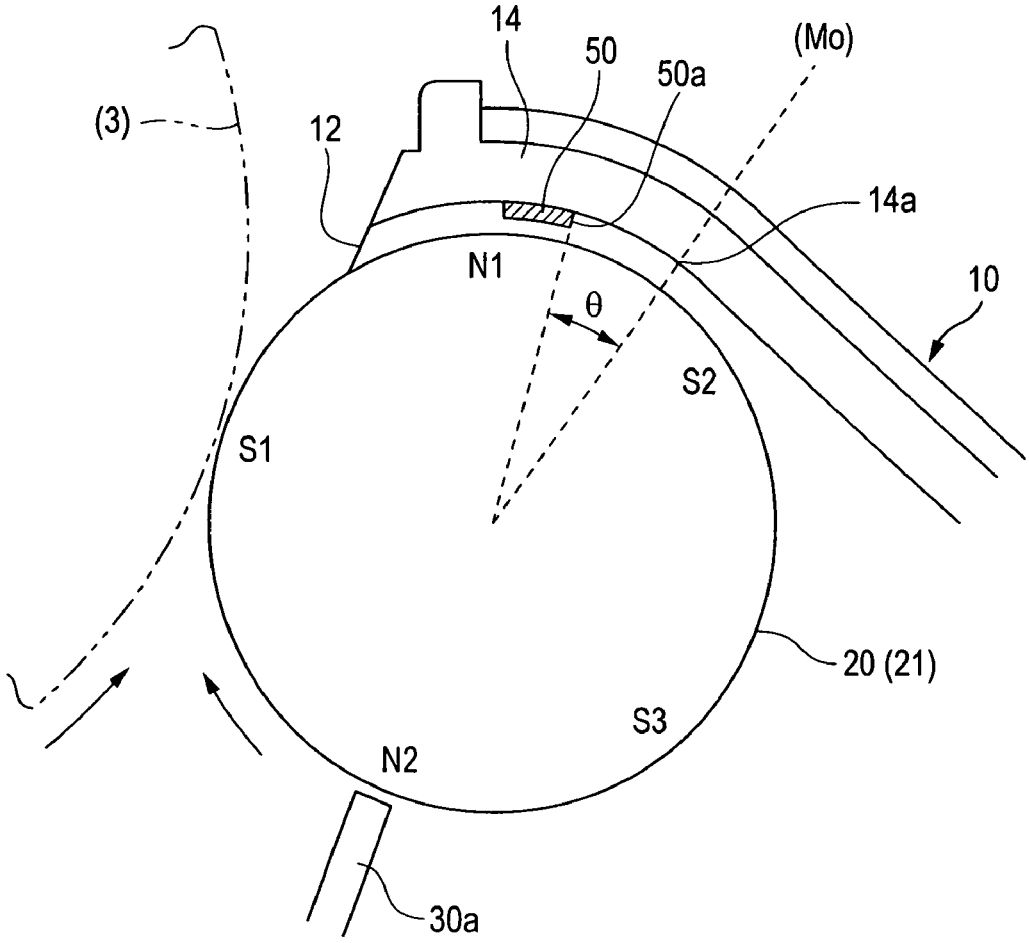
FIG. 12 is an explanatory view of the structure contents of the developing device according to the invention used in the test 2.

To form the projecting portion, as shown in FIG. 12, there is used a test piece 50 having a rectangular-shaped section, a thickness of 0.5 mm and a sleeve rotation direction length of 3 mm, and the test piece is bonded to the respective positions of the opposed portion 14 of the housing 10. In this case, the bonding position (forming position) of the test piece 50 is specified by an angle: ±θ (°) formed between the sleeve rotation direction downstream side end portion (end face) 50*a* of the test piece 50 and the portion 14*a* of the opposed portion 14 crossing a point (Mo) where the normal direction magnetic flux provides 0 mT, with the crossing portion 14*a* as a reference. For example, when the end portion 50*a* of the test piece 50 is made to coincide with the crossing portion 14*a*, the forming position of the test piece 50 is expressed as θ=0°.

Figure 7:
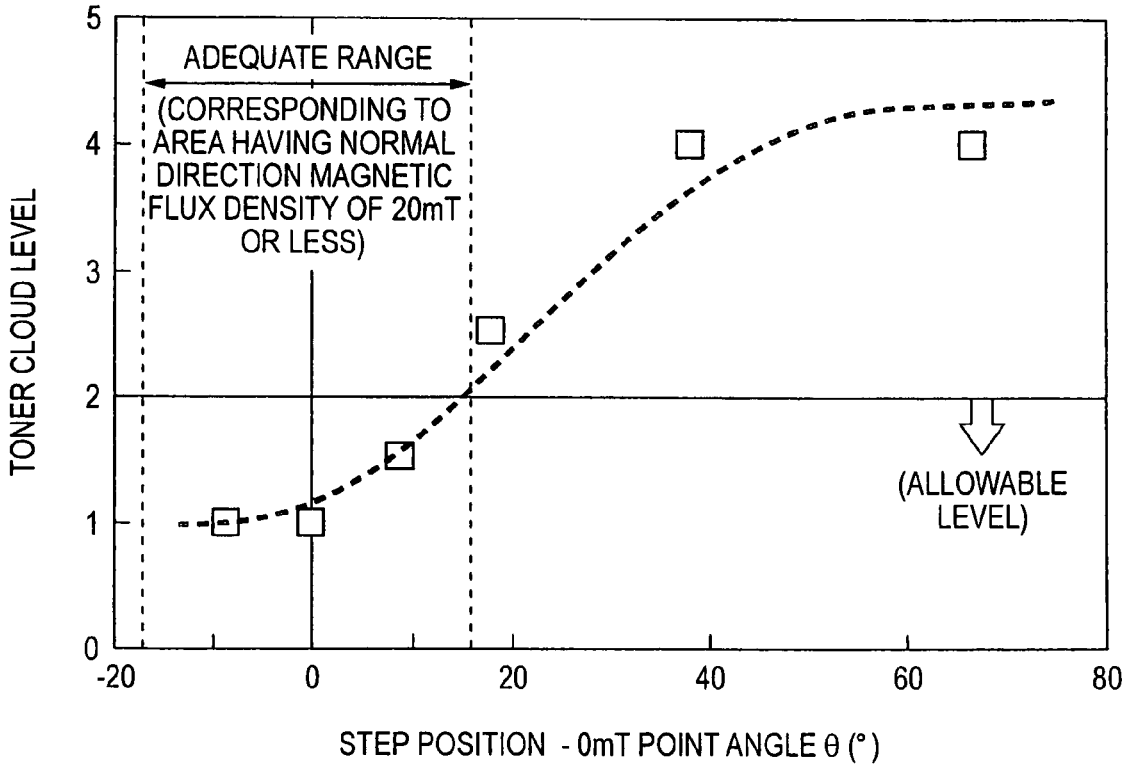
FIG. 7 is a graphical representation of the results of a test 2.

As the developing devices, there are prepared developing devices having the same conditions as those used in the test 1 except that the condition of the projecting portion is changed in the above-mentioned manner. And, similarly to the test 1, after the respective developing devices are mounted onto their associated printers and print for the test is carried out, the test print is checked for the occurring states of the toner cloud, and the toner cloud occurring states are evaluated respectively. In the present test print, the developer carry amount is set for 450 g/m$^2$. FIG. 7 shows the evaluation results. In FIG. 7, there are shown not only an approximate curve but also a range in which the normal direction magnetic flux density is 20 mT or lower.

OTHER EMBODIMENTS

Figure 8:
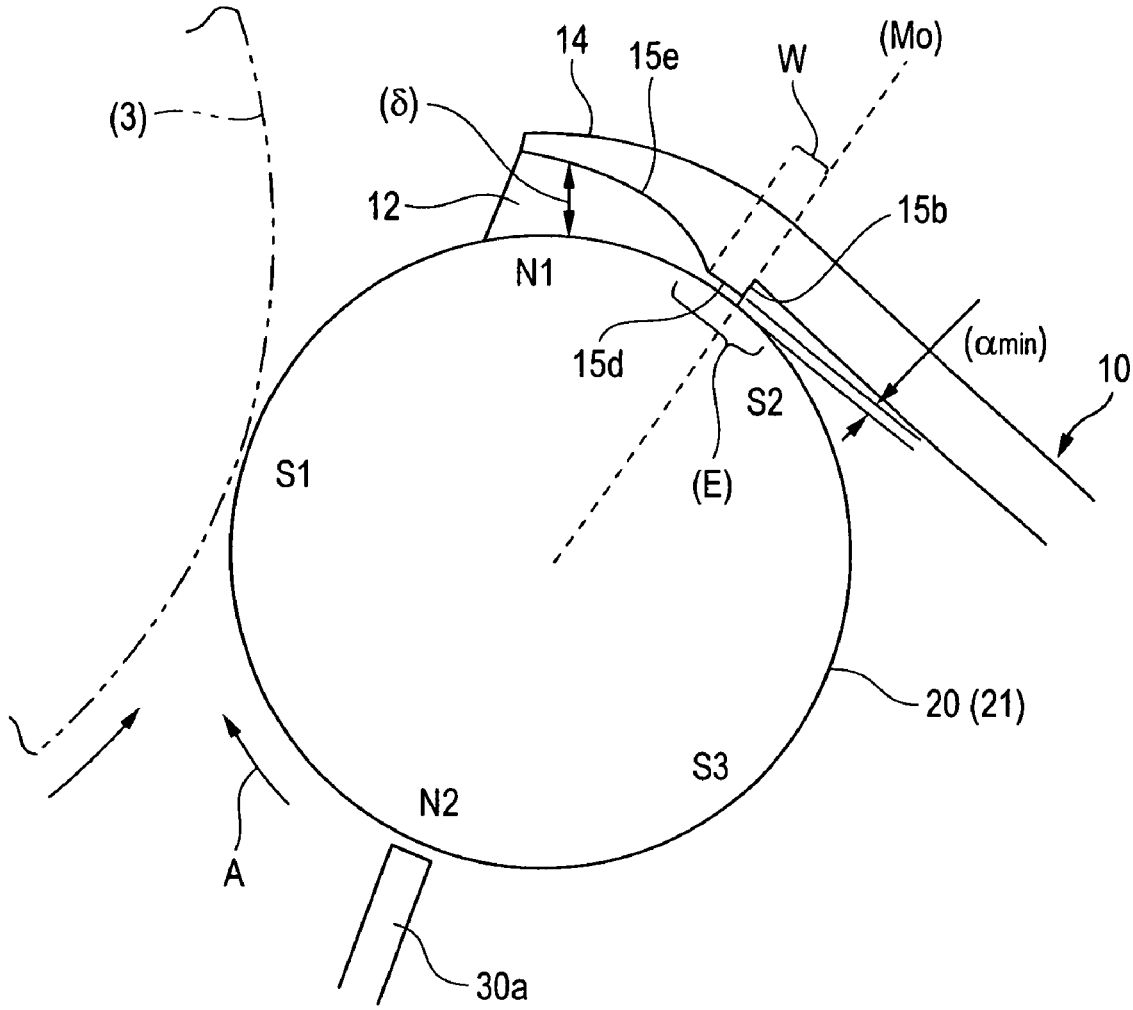
FIG. 8 is an explanatory view of another structure example 1 of a projecting portion.
Figure 9:
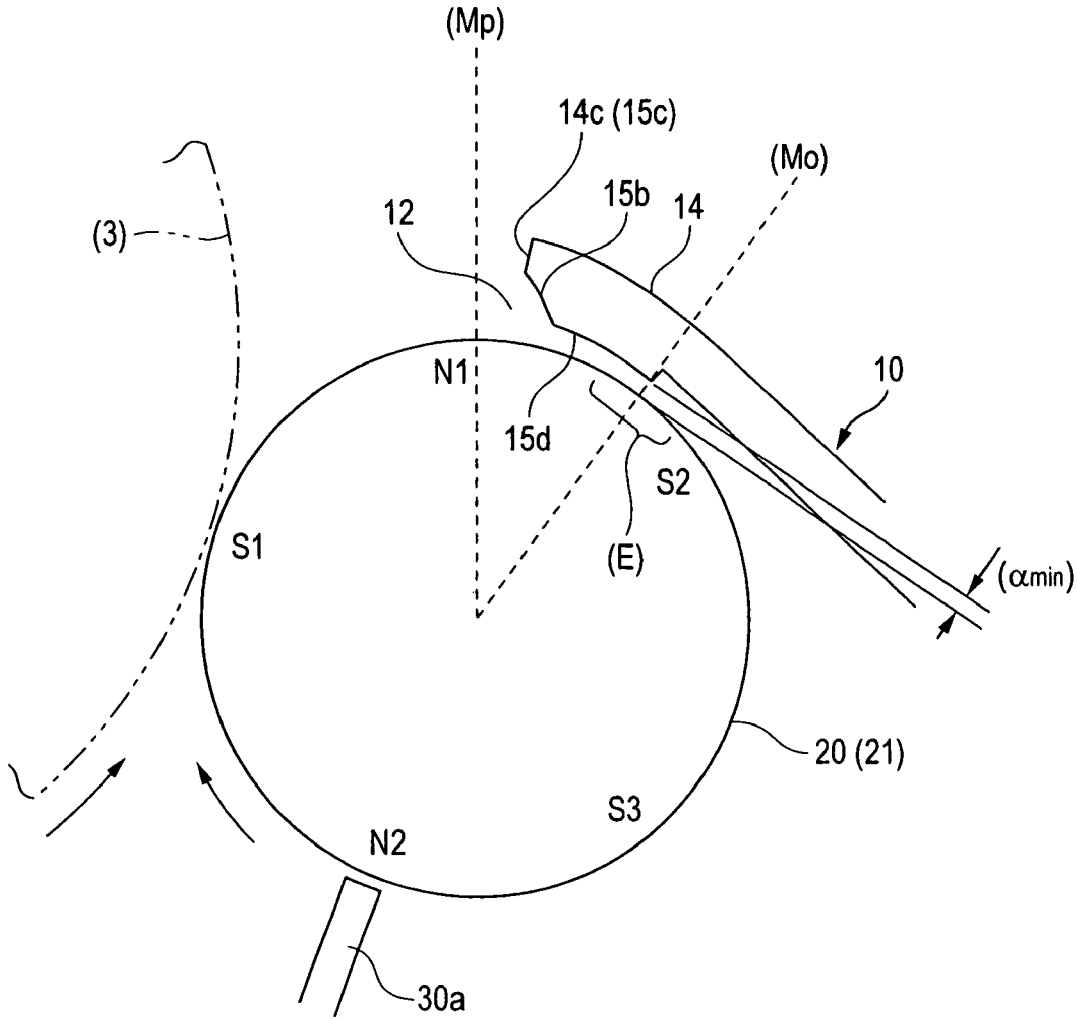
FIG. 9 is an explanatory view of another structure example 2 of a projecting portion.
Figure 10:
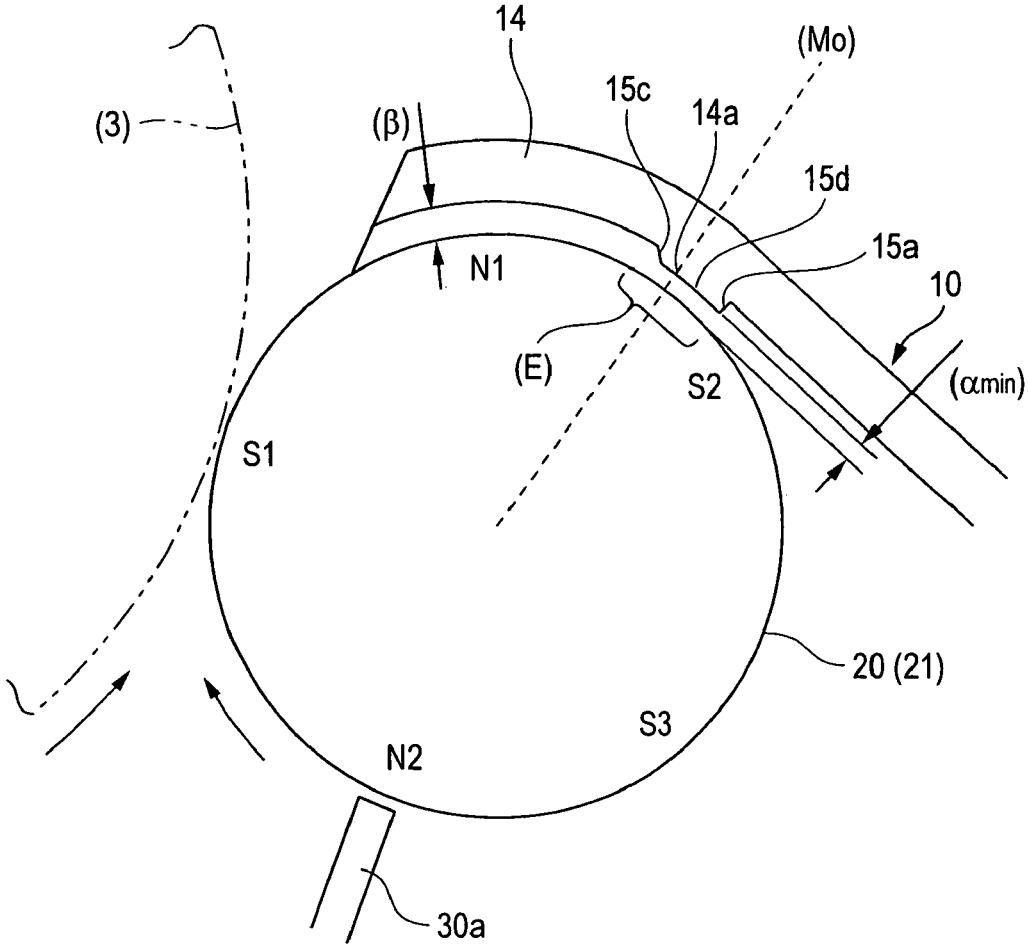
FIG. 10 is an explanatory view of another structure example 3 of a projecting portion.

As regards the projecting portion 15 to be formed in the opposed portion 14 of the housing 10 in the above-mentioned embodiment, it is not limited to the structure shown in the present embodiment but, for example, there may also be employed such structures as shown in FIGS. 8~10.

Specifically, as regards a projecting portion 15 shown in FIG. 8, on the upstream side of the rotation direction of the sleeve 21 from the end portion 15*a* of the projecting portion 15, there is formed a minimum clearance surface portion 15*d* which is opposed to the outer peripheral surface of the sleeve 21 with the same minimum clearance (α min) between them over a width w. The width w of the minimum clearance surface portion 15*d*, preferably, may be set for a dimension which is contained within an area E where the normal direction magnetic flux density is 20 mT or less. Also, in the present projecting portion 15, the portion of the opposed portion 14, which extends on the upstream side of the sleeve rotation direction from the minimum clearance surface portion 15*d*, is formed as an inclined curved surface 15*e* in which a clearance (δ) between the present portion and the outer peripheral surface of the sleeve 21 gradually increases up to the opening 12.

As regards a projecting portion 15 shown in FIG. 9, in addition to the formation of the minimum clearance surface portion 15*d* similarly to the projecting portion 15 shown in FIG. 8, the sleeve rotation direction upstream side end portion 15*c* thereof, together with the end portion 14*c* of the opposed portion 14 on the opening side 12, is terminated at a position on this side of a point (Mp) where the normal direction magnetic flux density of the post-development carry magnetic pole N1 provides a peak value. Here, the minimum clearance surface portion 15*d* of the projecting portion 15 is formed so as to extend up to a position which exists beyond the area E providing a normal direction magnetic flux density of 20 mT or less. However, preferably, it may be formed such that it is contained inside the area E.

As regards a projecting portion 15 shown in FIG. 10, the minimum clearance surface portion 15*d* thereof is formed to have such a width dimension that such portion 15*d* is contained only inside the area E providing a normal direction magnetic flux density of 20 mT or less while the portion 15*d* contains therein the portion 14*a* corresponding to the point (Mo) where the normal direction magnetic flux density provides 0 mT.

Also, when there is used a magnet roller 22 employing a magnetic pole arrangement structure in which there are present two or more areas E each having a normal direction magnetic flux density of 20 mT or less in the opposed portion 14 of the housing 10, a projecting portion 15 to be formed in the opposed portion 14 can be formed such that the projecting portion 15 is contained in at least one of the areas E; and, preferably, the projecting portion 15 may be formed such that it is contained at least in the area E that exists nearest to the opening 12.

The developing devices according to the above-mentioned embodiments of the invention can be applied to a single or multiple color image forming apparatus represented by a printer, a copying machine, a facsimile and the like which use an electrophotographic system or an electrostatic recording system.

What is claimed is:

1. A developing device comprising:

a case having a developing opening disposed opposed to a developing area;

a cylindrical-shaped developer carry member that is disposed at the developing opening of the case, a part of the developer carry member being exposed, the developer carry member rotating with holding and carrying a developer containing toner and magnetic carriers;

a magnet member that is fixed within an internal space of the developer carry member and that has two or more magnetic poles including a developing magnetic pole and a developer peel-off magnetic pole, the magnetic poles being arranged along a rotation direction of the developer carry member;

a projection portion formed in a portion of the case that opposes the outer peripheral surface of the developer carry member, the portion of the case also including an area that extends from the developing magnetic pole of the magnet member in the rotation direction of the developer carry member up to the developer peel-off magnetic pole, the magnet member having a normal direction magnetic flux density of 20 mT or less in an area where the projection portion is formed;

a clearance formed between an opposed portion of the projection portion and the outer peripheral surface of the developer carry member, the clearance becoming narrowest in the portion of the case; and a magnetic pole disposed firstly on a upstream side of the developer carry member relative to the area of the magnet member having the magnetic flux density of 20 mT or less, the magnetic pole providing a peak value in a peak value area, wherein the projection portion is formed in an area other than the peak value area.

2. A developing device as set forth in claim 1, wherein the projection portion is formed such that it exists only within a portion corresponding to the area having the magnetic flux density of 20 mT or less.

3. A developing device as set forth in claim 1, wherein a portion of the case existing on a upstream side in the rotation direction of the developer carry member from the projection portion is formed such that a clearance between the portion of the case and the outer peripheral surface of the developer carry member increases as it approaches a portion of the case corresponding to a point where a normal direction magnetic flux of the magnetic pole disposed firstly on the upstream side in the rotation direction of the developer carry member from the area of the magnet member having the magnetic flux density of 20 mT or less provides a peak value.

4. A developing device as set forth in claim 1, wherein a portion of the projection portion existing on the downstream side of the rotation direction of the developer carry member comprises a steep surface extending substantially parallel to a virtual line going outward in a diameter direction of the magnet member so as to be able to broaden a clearance between the projection portion and the outer peripheral surface of the developer carry member.

5. An image forming apparatus comprising:

an image hold member that forms a latent image thereon; and a developing device that develops the latent image on the image hold member, wherein the developing device is a developing device as set forth in claim 1.

* * * * *